US012158164B2

(12) United States Patent
Kuzdzal

(10) Patent No.: US 12,158,164 B2
(45) Date of Patent: Dec. 3, 2024

(54) SCULPTED LOW SOLIDITY VANED DIFFUSER

(71) Applicant: FoxRES LLC, New York, NY (US)

(72) Inventor: Mark J. Kuzdzal, Deer Park, TX (US)

(73) Assignee: FOXRES LLC, Olean, NY (US)

( * ) Notice: Subject to any disclaimer, the term of this patent is extended or adjusted under 35 U.S.C. 154(b) by 0 days.

(21) Appl. No.: 18/236,252

(22) Filed: Aug. 21, 2023

(65) Prior Publication Data

US 2024/0060507 A1 Feb. 22, 2024

Related U.S. Application Data

(60) Provisional application No. 63/399,985, filed on Aug. 22, 2022.

(51) Int. Cl.

| | |
|---|---|
| ***F04D 29/28*** | (2006.01) |
| ***F04D 17/10*** | (2006.01) |
| ***F04D 29/44*** | (2006.01) |

(52) U.S. Cl.

CPC ..... *F04D 29/444* (2013.01); *F04D 17/10* (2013.01); *F04D 29/284* (2013.01); *F04D 29/44* (2013.01)

(58) Field of Classification Search

CPC ..... F04D 29/444; F04D 17/10; F04D 29/284; F04D 29/44

See application file for complete search history.

(56) References Cited

U.S. PATENT DOCUMENTS

| | | | | |
|---|---|---|---|---|
| 2,967,013 | A * | 1/1961 | Dallenbach | F04D 29/444 415/181 |
| 4,938,661 | A * | 7/1990 | Kobayashi | F04D 17/122 415/199.1 |
| 5,178,516 | A * | 1/1993 | Nakagawa | F04D 29/444 415/211.2 |
| 5,310,309 | A * | 5/1994 | Terasaki | F04D 29/444 415/211.2 |
| 5,529,457 | A * | 6/1996 | Terasaki | F04D 29/444 415/208.4 |
| 10,760,587 | B2 | 9/2020 | Larosiliere et al. | |
| 2001/0033792 | A1* | 10/2001 | Nagaoka | F04D 1/06 415/208.3 |
| 2012/0014788 | A1* | 1/2012 | Blair | F04D 29/444 415/208.2 |
| 2013/0224004 | A1 | 8/2013 | Radhakrishnan et al. | |
| 2014/0205458 | A1 | 7/2014 | Japikse | |
| 2016/0252101 | A1 | 9/2016 | Rubino et al. | |
| 2017/0248154 | A1* | 8/2017 | Nakaniwa | F04D 29/442 |
| 2020/0072239 | A1* | 3/2020 | Combier | F01D 5/141 |

FOREIGN PATENT DOCUMENTS

CN 114867944 A 8/2022

OTHER PUBLICATIONS

PCT International Search Report and Written Opinion for corresponding International Application No. PCT/US2023/0307788; Dated Jan. 3, 2024; 17 pages.

* cited by examiner

*Primary Examiner* — David E Sosnowski
*Assistant Examiner* — Theodore C Ribadeneyra
(74) *Attorney, Agent, or Firm* — Nolte Lackenbach Siegel

(57) ABSTRACT

A low solidity diffuser vane includes a vane body having a shroud side, a hub side, and a sculpted leading edge connecting the shroud side to the hub side.

24 Claims, 13 Drawing Sheets

Pressure Ratio

$$PR_{tt} = \left(1 + \frac{\eta}{C_P T_{00}} (U_2 C_{\theta 2} - U_1 C_{\theta 1})\right)^{\frac{k}{k-1}}$$

Specific work (Euler eqauation)

$$W = (U_2 C_{\theta 2} - U_1 C_{\theta 1}) + W_{losses}$$

Pressure Ratio and work performed are a function of blade speed and change in tangential velocity

SCULPTED LOW SOLIDITY VANED DIFFUSER

CROSS-REFERENCE TO RELATED APPLICATIONS

The priority and earlier effective filing date of U.S. Application Ser. No. 63/399,985, filed Aug. 22, 2022, is hereby claimed for all purposes, including the right of priority. This related application is also hereby incorporated by reference for all purposes as it expressly set forth verbatim herein.

BACKGROUND

This section introduces information from the art that may be related to or provide context for some aspects of the technique described herein and/or claimed below. This information is background information facilitating a better understanding of that which is disclosed herein. This is a discussion of "related" art. That such art is related in no way implies that it is also "prior" art. The related art may or may not be prior art. The discussion is to be read in this light, and not necessarily as admissions of prior art except where designated as prior art.

As a centrifugal compressor impeller rotates, it imparts energy into a compressible fluid. As the energy is added to the fluid, it takes two forms, both kinetic (velocity) and potential (static pressure) energy. The kinetic energy (fluid velocity) exits the impeller at an angle (C2) as shown in FIGS. 1 and 2, the velocity vector of the fluid The velocity vector is typically characterized as having a radial ($C_{m2}$) and tangential ($C_{\Theta 2}$) component.

The main functions of a centrifugal compressor radial diffuser are to gather the gas, and gradually decelerate the gas converting the kinetic energy (gas velocity) into potential energy. This potential energy takes the form of increased static pressure. Between the impeller exit and the diffuser entrance can be a very complicated flow field and the design must ensure stall cell(s) do not form. These cells are more likely with highly tangential flow where the gas does not have enough radial momentum to carry it to the exit of the diffuser.

FIG. 3A depicts a low flow impeller while FIG. 3B depicts a high flow impeller. As the gas exits the low flow impeller the gas angle variation from hub to shroud is low making it a good candidate for a low solidity vane positioned in the diffuser ("LSD"). These vanes aid in pressure recovery, improving efficiency without negatively impacting the aerodynamic range of the stage. Conversely in a high flow coefficient impeller the gas exit angle on the shroud side, and hub side can vary significantly. Research from two separate sources suggests large variations in flow angles (15° or more). FIG. 4A and FIG. 4B were published in Y. Jung, M. Choi, S. Oh, and J. Baek, "Effects of a Nonuniform Tip Clearance Profile on the Performance and Flow Field in a Centrifugal Compressor", 2012 International Journal of Rotating Machinery, Article ID 340439. This research shows an example where on the shroud side the gas radial velocity is approaching zero and going negative. These low angles suggest an area of low momentum fluid on the shroud side and the possibility for an aerodynamic stall.

FIG. 5A and FIG. 5B were published in M. Schleer, S. S. Hong, M. Zangeneh, C. Roduner, B, Ribi, F. Ploeger, and R. S. Abhari, "Investigation of an Inversely Designed Centrifugal Compressor Stage Part 2: Experimental Investigations", Proceedings of ASME TURBO EXPO (2003). FIG. 5A illustrates the time averaged absolute flow angle as a function of location between the hub and the shroud. FIG. 5B illustrates the time averaged absolute tangential velocity as a function of location between the hub and the shroud.

Currently there are two LSD designs reduced to practice in conventional practice. The first is a vaned diffuser. FIG. 6A and FIG. 6B depict an LSD in which the vane is the full width of the diffuser. The leading edge is co-linear with the axis of rotation and generally at a diffuser radius ratio between ("DRR") of 1.05 to 1.15. For present purposes, DRR is the ratio of the vane leading edge radius (r3) divided by the impeller outer radius (r2), Restated the leading edge maybe 105% of the impeller diameter, 106%, 107% . . . to 115% of the impeller diameter. Generally, these vanes are utilized in mid to low flow stages where the flow field (gas tangential velocity from hub to shroud) entering the diffuser is relatively consistent. The second design is a vaneless diffuser. In this embodiment there are no vanes placed in the diffuser. FIG. 7A shows a drawing of an LSD ring before it is mounted in the diffuser. FIG. 7B shows a vaneless diffuser.

FIG. 8A and FIG. 8B depict yet another low solidity vane diffuser, called a rib diffuser. In this embodiment, the vanes generally occupy 20%-33% of the diffuser passage width and originate from the shroud side. This design is employed in high flow impeller stages where the flow angels from shroud to hub are large. The rib diffuser is a compromise between a vaned and vaneless diffuser, the vane does not cross the entire passage width and pressure recovery is not as high as a full vaned diffuser. Again, the vane leading edge is co-linear to the axis of rotation. FIG. 8C depicts a rib diffuser vane. A longer vane length (axial direction) would hamper pressure recovery and deteriorate aerodynamic performance, because the gas incidence angle would not match the vane angle.

SUMMARY

In a first aspect, a low solidity diffuser vane comprises a vane body including a shroud side, a hub side, and a sculpted leading edge connecting the shroud side to the hub side.

In a second aspect, a low solidity vaned diffuser for use in a centrifugal compressor comprises a diffuser body defining a passageway and a low solidity diffuser vane disposed within the passageway. The low solidity diffuser vane further comprises a vane body including a shroud side, a hub side, and a sculpted leading edge connecting the shroud side to the hub side.

In a third aspect, a centrifugal compressor comprises an impeller and a low solidity vaned diffuser. The low solidity vaned diffuser comprises a diffuser body defining a passageway and a low solidity diffuser vane disposed within the passageway. The low solidity diffuser vane further comprises a vane body including a shroud side, a hub side, and a sculpted leading edge connecting the shroud side to the hub side.

In a fourth aspect, in some embodiments, the sculpted leading edge is also twisted.

The above presents a simplified summary in order to provide a basic understanding of some aspects of the invention. This summary is not an exhaustive overview of the invention. It is not intended to identify key or critical elements of the disclosure or to delineate the scope of the invention. Its sole purpose is to present some concepts in a simplified form as a prelude to the more detailed description that is discussed later.

BRIEF DESCRIPTION OF THE DRAWINGS

The subject matter disclosed below may be understood by reference to the following description taken in conjunction with the accompanying drawings, in which like reference numerals identify like elements, and in which.

While the disclosed technique is susceptible to various modifications and alternative forms, the drawings illustrate specific embodiments herein described in detail by way of example. It should be understood, however, that the description herein of specific embodiments is not intended to limit that which is claimed to the particular forms disclosed, but on the contrary, the intention is to cover all modifications, equivalents, and alternatives falling within the spirit and scope of the appended claims.

DETAILED DESCRIPTION

Illustrative embodiments of the subject matter claimed below will now be disclosed. In the interest of clarity, not all features of an actual implementation are described in this specification. It will be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

Figure 9:
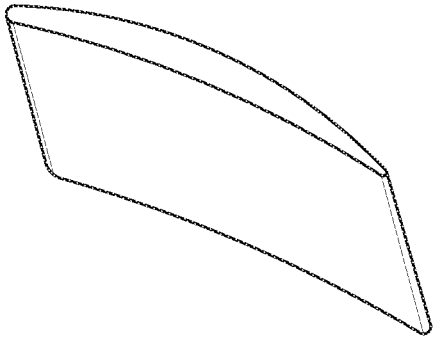
FIG. 9 (PRIOR ART)
FIG. 9 shows a conventional LSD (full width) vane.
Figure 10:
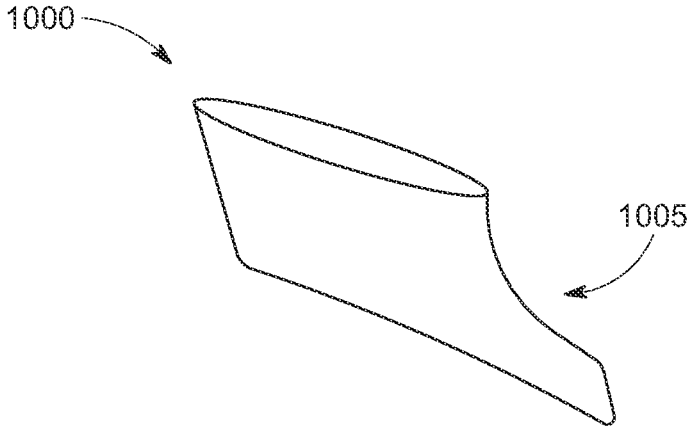
FIG. 10 shows an LSD vane in accordance with one or more embodiments of the subject matter claimed below that includes a sculpted leading edge where the vane leading edge is not co-linear to the axis of rotation.
Figure 11:
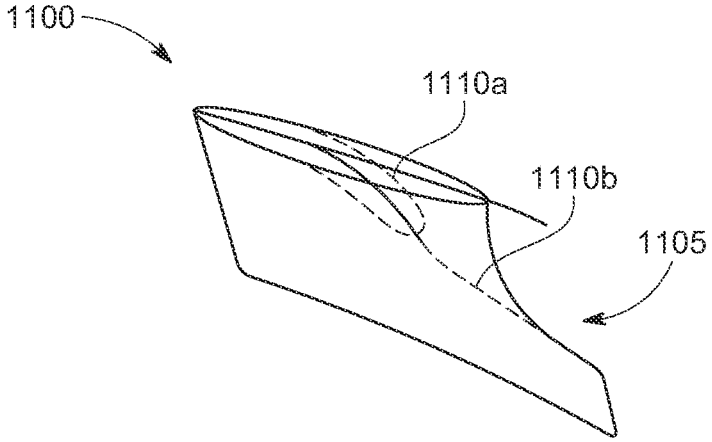
FIG. 11 depicts a sculpted and twisted leading edge, dashed lines in accordance with one or more embodiments of the subject matter claimed below.

In high flow radial impeller applications, what is needed is a novel low solidity diffuser vane design that offers a sculpted and or twisted leading edge. FIG. 9 shows at a conventional LSD (full width) vane. In contrast, FIG. 10 show an LSD vane 1000 in accordance with one or more embodiments of the subject matter claimed below. The LSD vane 1000 in FIG. 10 includes a sculpted leading edge 1005 where the vane leading edge 1005 is not co-linear to the axis of rotation. Thus, as used herein, the term "sculpted leading edge" means that the leading edge is not co-linear to the axis of rotation for the impeller and that its leading-edge shape can generally be defined in two-dimensional space. FIG. 11 depicts an LSD vane 1100 including a sculpted and twisted leading edge 1105, the dashed lines 1110*a*, 1110*b* in accordance with one or more embodiments of the subject matter claimed below. As used herein, the term "twisted leading edge" means that the leading edge is not co-linear to the axis of rotation for the impeller and its leading-edge shape can generally be defined in three-dimensional space.

Figure 7A:
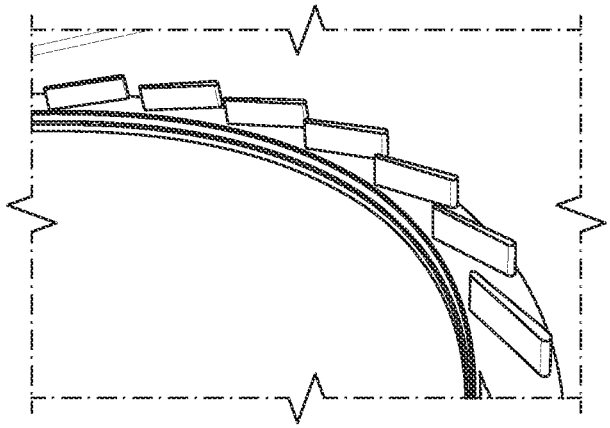
FIG. 7A (PRIOR ART)
FIG. 7A shows a conventional LSD ring and FIG. 7B shows a conventional vaneless diffuser.
Figure 7B:
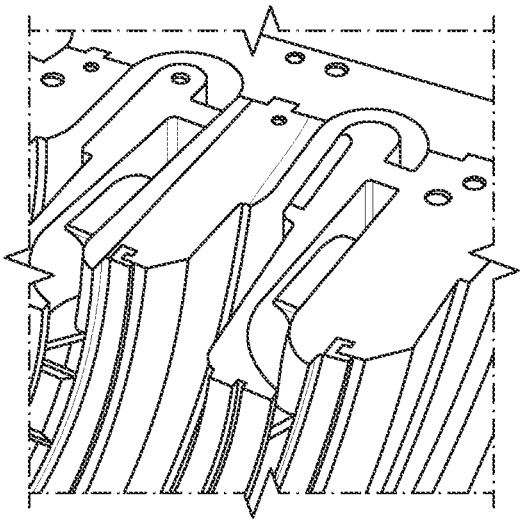
FIG. 7B (PRIOR ART)
Figure 8A:
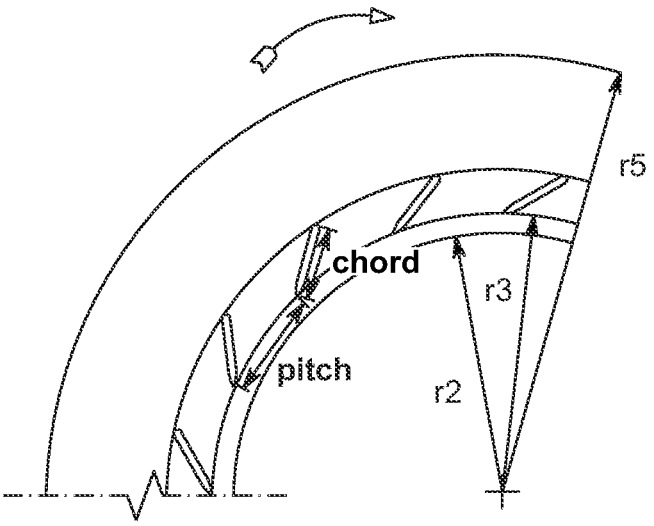
FIG. 8A (PRIOR ART)
FIG. 8A and FIG. 8B depict yet another conventional low solidity vane diffuser, called a rib diffuser.
Figure 8B:
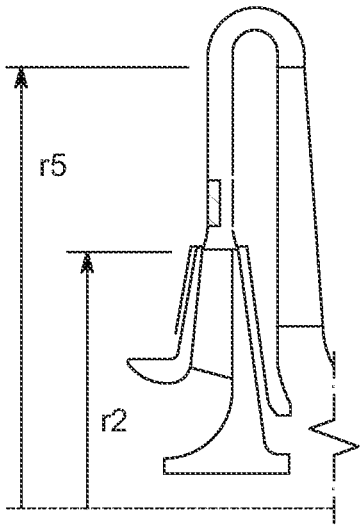
FIG. 8B (PRIOR ART)
Figure 8C:
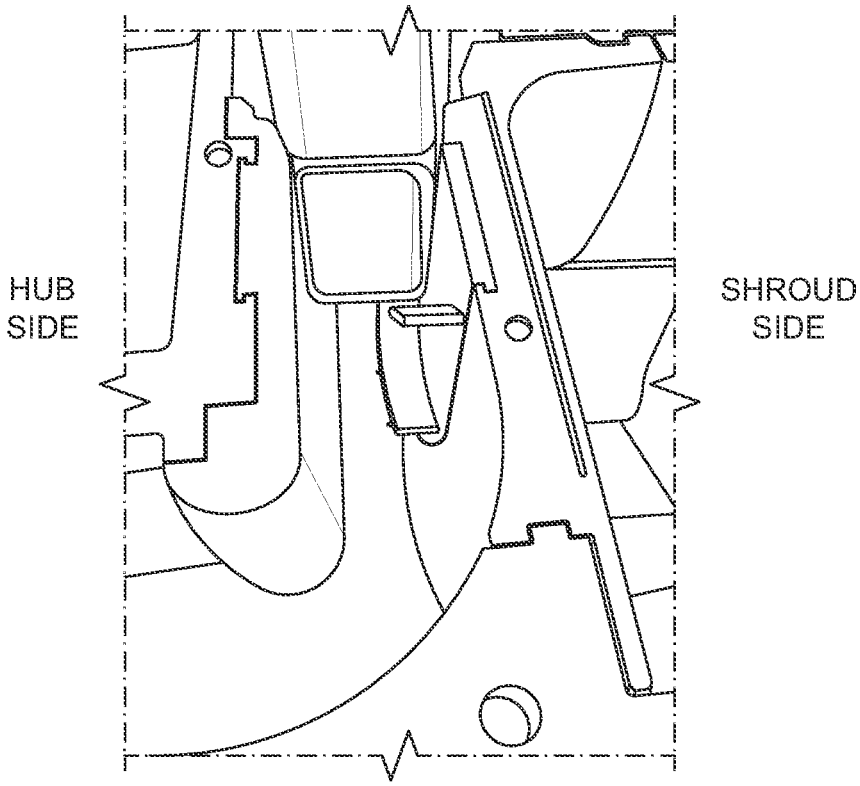
FIG. 8C (PRIOR ART)
FIG. 8C depicts a conventional rib diffuser vane.
Figure 12:
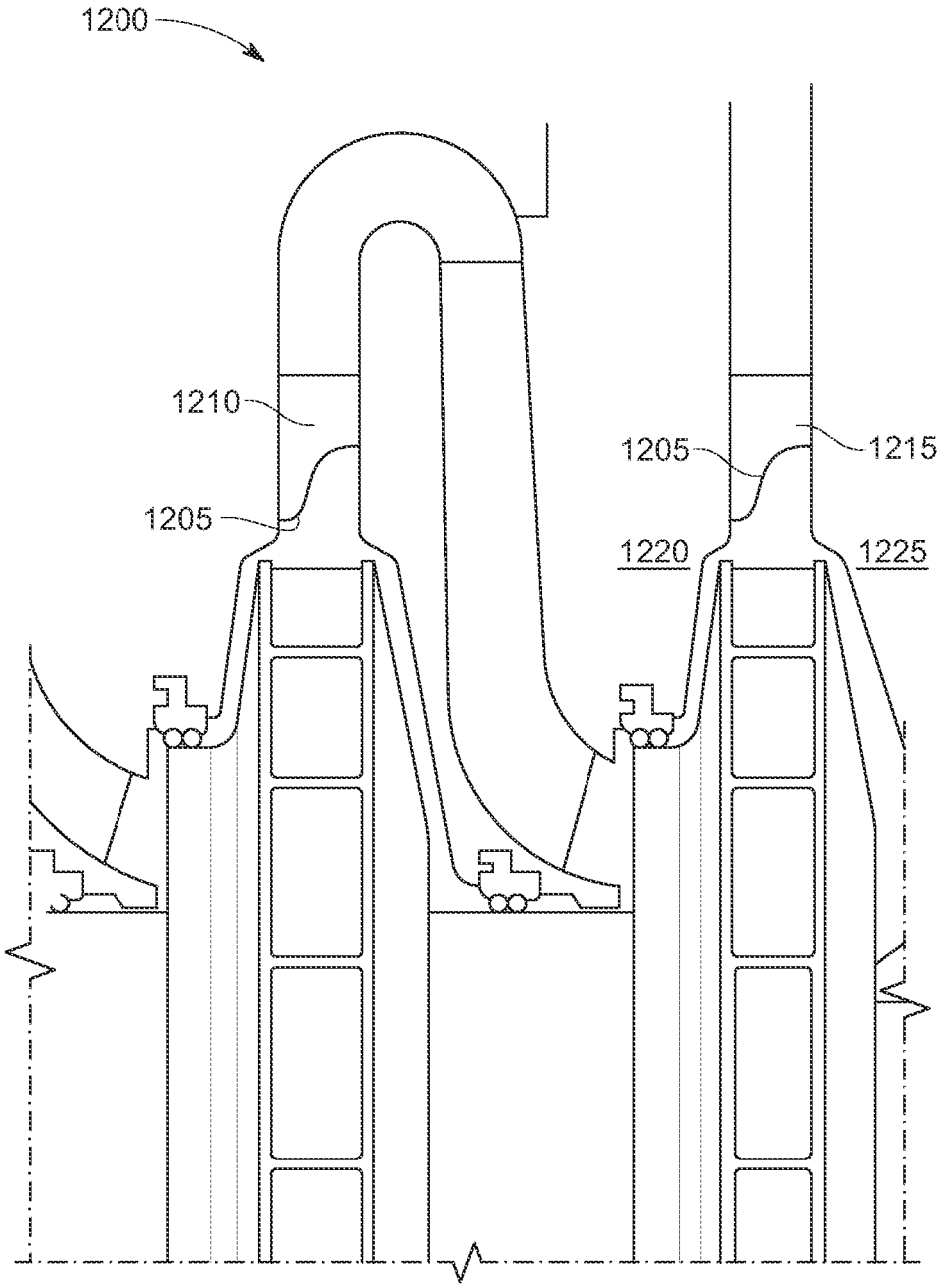
FIG. 12 provides an exemplary view of one sculpted leading edge in accordance with one or more embodiments of the subject matter claimed below.

FIG. 12 illustrates one particular embodiment 1200 and provides an exemplary view of one leading edge 1205 deployed on a first LSD vane 1210 and on a second LSD vane 1215. Those in the art having the benefit of this disclosure will appreciated that, although only two vanes are shown in FIG. 12, there will be a larger a plurality of vanes around the circumference of the impeller similar to what is shown for the convention design in FIG. 7A. Thus, there will not be only a single vane, but a series of vanes—generally between ten and thirty. All vanes wrapped around an impeller in any given embodiment will have the same sculpted shape.

As an example, the diffuser width in FIG. 12 has been sectioned into five axial pieces, referenced as locations 1 to 5, for purposes of discussion. Location 1 is immediately adjacent to the shroud 1220 and location 5 is immediately adjacent to the hub 1225. Location 3 is at mid passage width. Examining the velocity triangle, at a DRR of 1.10 there is a variation of gas radial and tangential velocity from hub to shroud as shown in FIG. 13.

Figure 1:
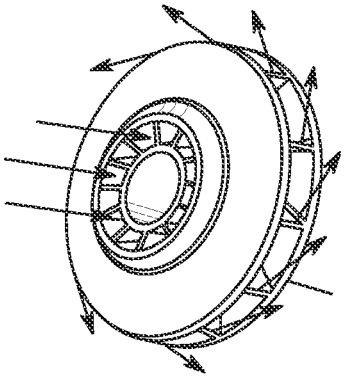
FIG.1 (PRIOR ART)
FIG. 1 and FIG. 2 illustrate the velocity vectors of a fluid into which a conventional impeller has imparted energy.
Figure 2:
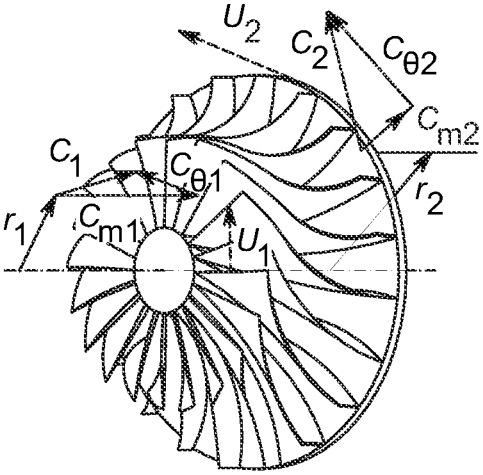
FIG.2 (PRIOR ART)
Figure 3B:
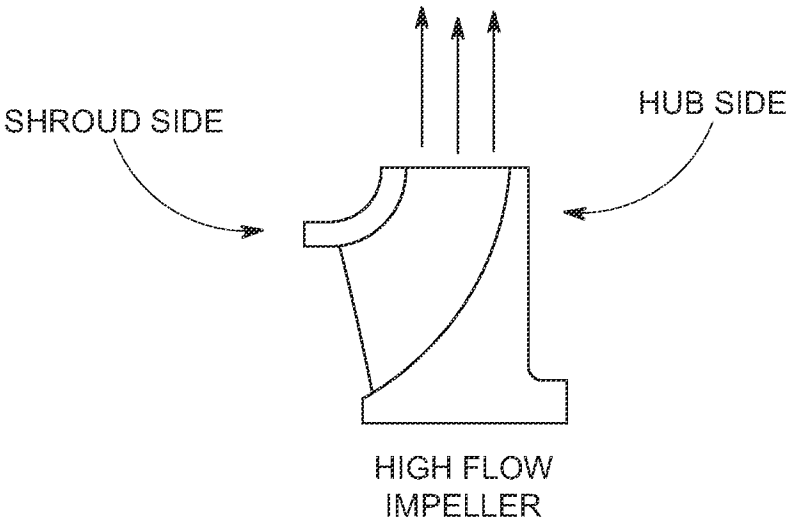
FIG. 3B (PRIOR ART)
FIG. 3A and FIG. 3B graphically depict fluid flow from a conventional low flow impeller and a high flow impeller, respectively.
Figure 3A:
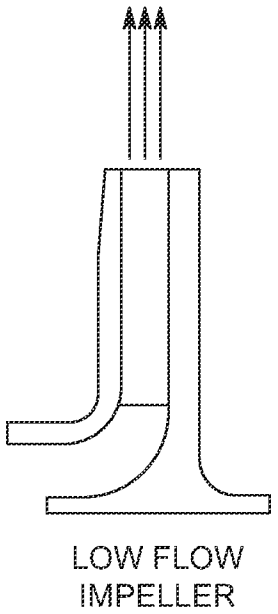
FIG. 3A (PRIOR ART)
Figure 4A:
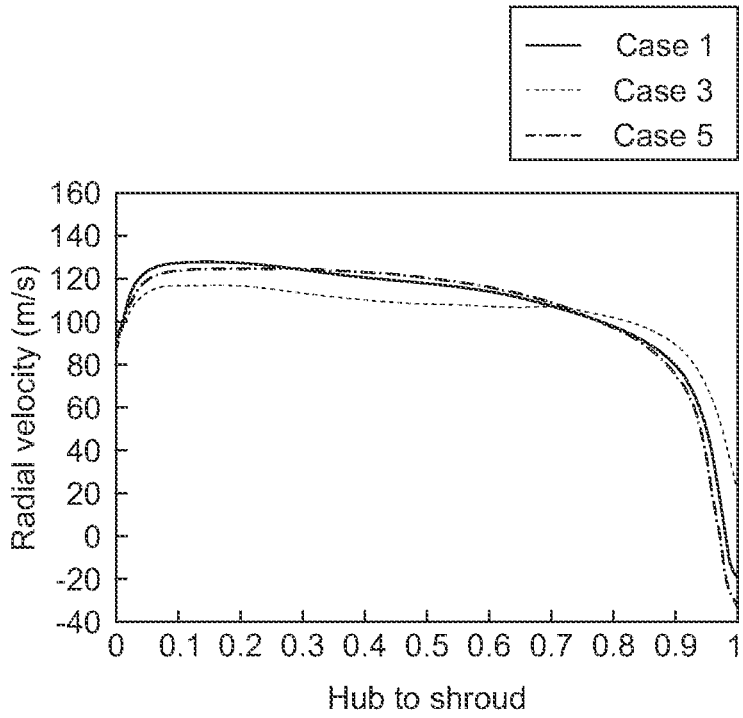
FIG. 4A (PRIOR ART)
FIG. 4A and FIG. 4B graph radial velocity and flow angle as shown in FIG. 1 and FIG. 2 as a function of location between the hub and shroud of a conventional low flow impeller and a high flow impeller, respectively.
Figure 4B:
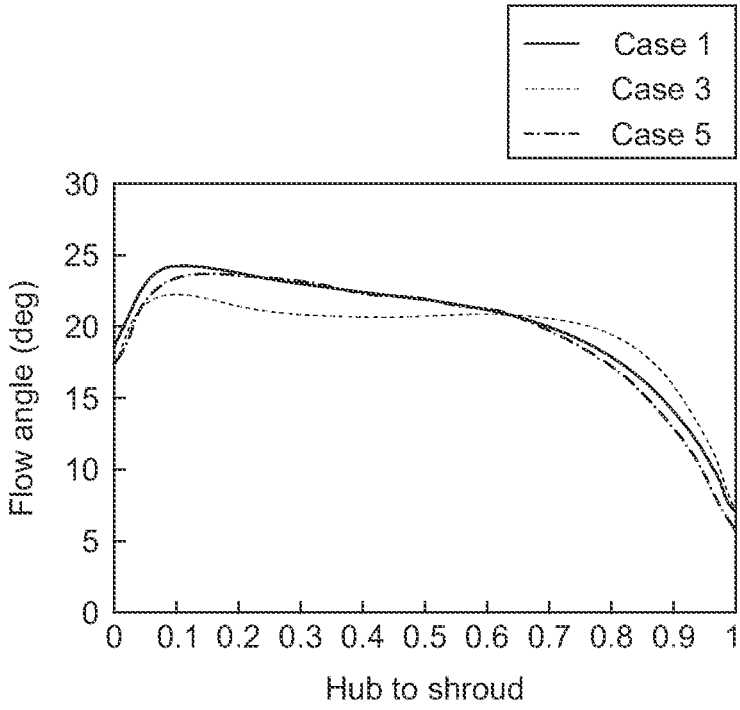
FIG. 4B (PRIOR ART)
Figure 5A:
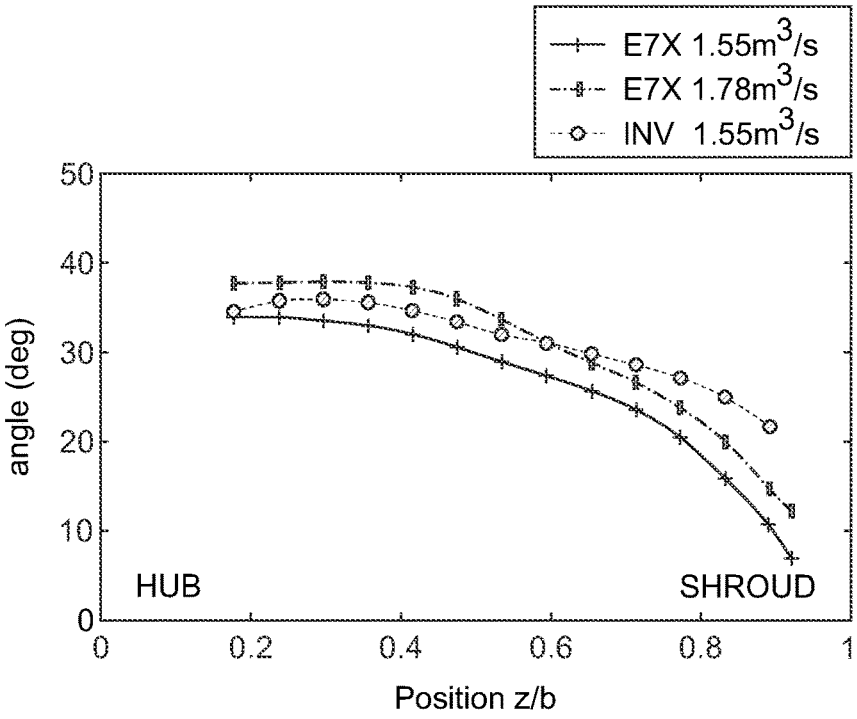
FIG. 5A (PRIOR ART)
FIG. 5A and FIG. 5B illustrate the time averaged absolute flow angle and the time averaged absolute tangential velocity, respectively, of a fluid into which a conventional impeller has imparted energy as a function of location between the hub and the shroud.
Figure 5B:
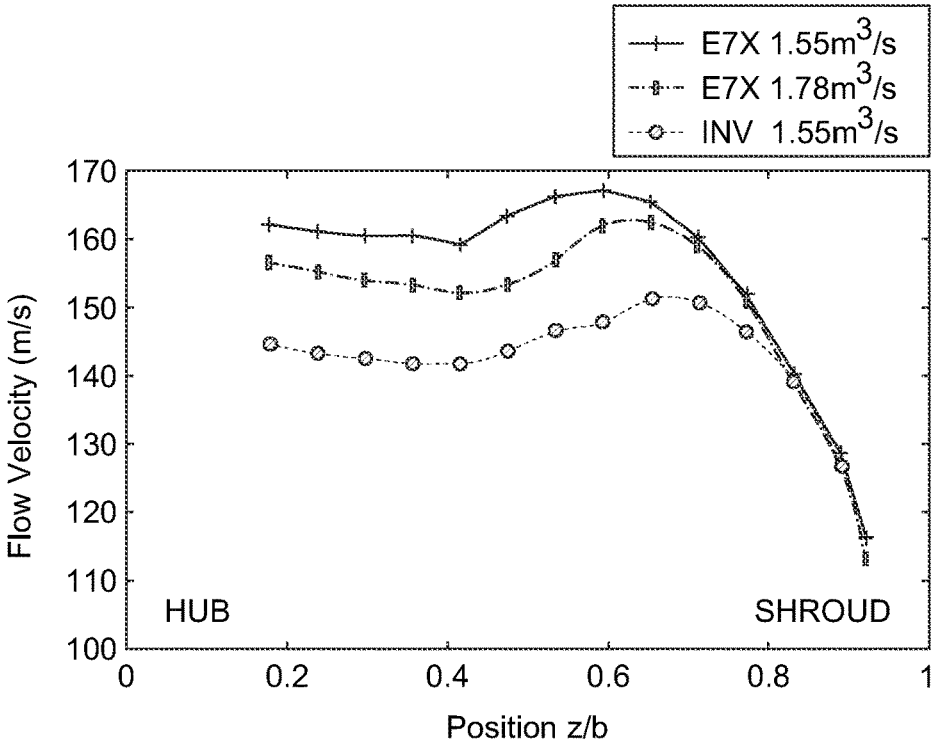
FIG. 5B (PRIOR ART)
Figure 6A:
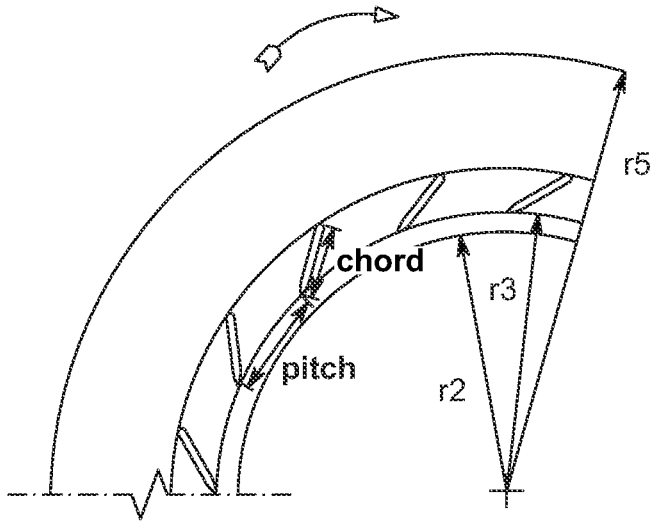
FIG. 6A (PRIOR ART)
FIG. 6A and FIG. 6B depict a conventional LSD which is the full width of the diffuser.
Figure 6B:
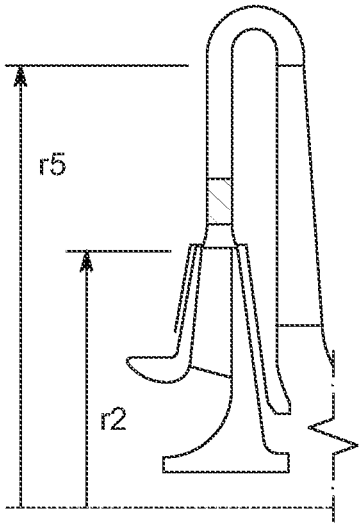
FIG. 6B (PRIOR ART)

Also as shown in FIG. 4B, reproduced from the article on the 'Effects of a Nonuniform Tip Clearance Profile on the Performance and Flow Field in a Centrifugal Compressor', a similar trend is depicted. Flow angle variation is approximately 25° from hub to shroud and gas radial velocity ($C_{m2}$) from 120 meters/second near the hub to zero meters/second near the shroud.

Figure 13:
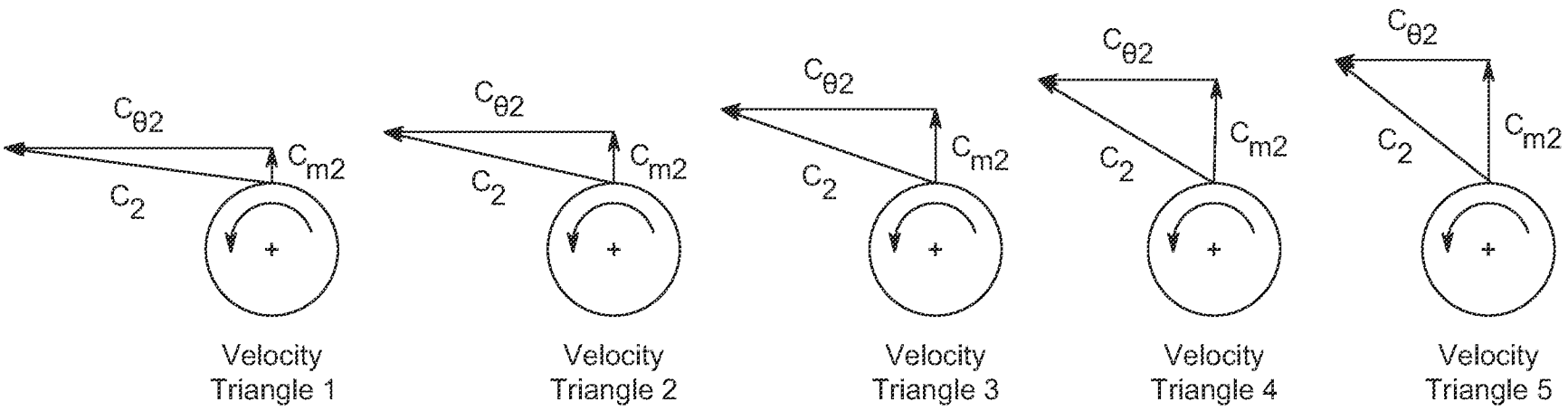
FIG. 13 illustrates the variation of gas radial and tangential velocity from hub to shroud.

In velocity triangle 1 of FIG. 13, the $C_{\Theta 2}$ term is much larger than the $C_{m2}$, term hence the resultant vector, $C_2$ term becomes very tangential. To maintain high aerodynamic efficiency, this highly tangential flow angle requires a vane leading edge, very close to the impeller tip, perhaps at a DRR of 1.05.

In velocity triangle 5, the $C_{\Theta 2}$ term is much less dominant and maybe of similar magnitude to the $C_{m2}$, term hence the resultant vector, $C_2$ term becomes less tangential. To maintain high aerodynamic efficiency, this less tangential flow angle requires a vane leading edge, further from the impeller tip, perhaps at a DRR of 1.15.

Instead of breaking the flow into five equal segments, one skilled in the art may imagine 50 or 500 segments, with velocity triangles that will follow the trend shown in FIG. 13, but with much more fidelity between each step.

The discussion immediately above defines the sculpted leading edge a variation in the DDR as a function of the location between the shroud side and the hub side. However, the sculpted leading edge may also be defined by the distance from the impeller as a function of the location between the shroud side and the hub side. In general, the more tangential the overall flow of the fluid the closer the leading edge should be to the impeller. So, on the shroud side where the overall fluid velocity is more tangential, the leading edge should be more proximal to the impeller. As one traverses the leading edge, the overall fluid flow becomes less tangential and more radial. Thus, the leading edge is designed to be more distal from the impeller as one traverses the leading edge. The leading edge is more distal from the impeller on the hub side.

As one skilled in the art may imagine, there are multiple forms of leading edges as illustrated by the leading edges 1405-1408 vanes 1400-1403 depicted FIG. 14A-FIG. 14D, respectively, and said leading edge should take the form of a continuous curve to best manage the flow. Generally, the lower diameter of the feature will occur between a DRR of 1.05 to 1.15 on the shroud side and the lower diameter of the feature may occur between a DRR of 1.08 to 1.35 on the hub side. The trailing edge may or may not be co-linear with the axis of rotation. The length of 'A', vane leading edge co-linear to the axis of rotation, in FIG. 14 could be zero to as large as 60% of the passage width. The trailing edge of the vane maybe co-linear to the axis of rotation, may follow the same shape as the vane leading edge or may have a different shape.

Also, as one skilled in the art may imagine the vane leading edge maybe twisted to a first angle at a DRR of 1.15 or to a second angle at a DRR of 1.10, with the intent being to utilize both parameters to ensure the angle of attack (incidence angle) of the vane best matches the gas flow angle as a function of the diffuser width.

Figure 14A:
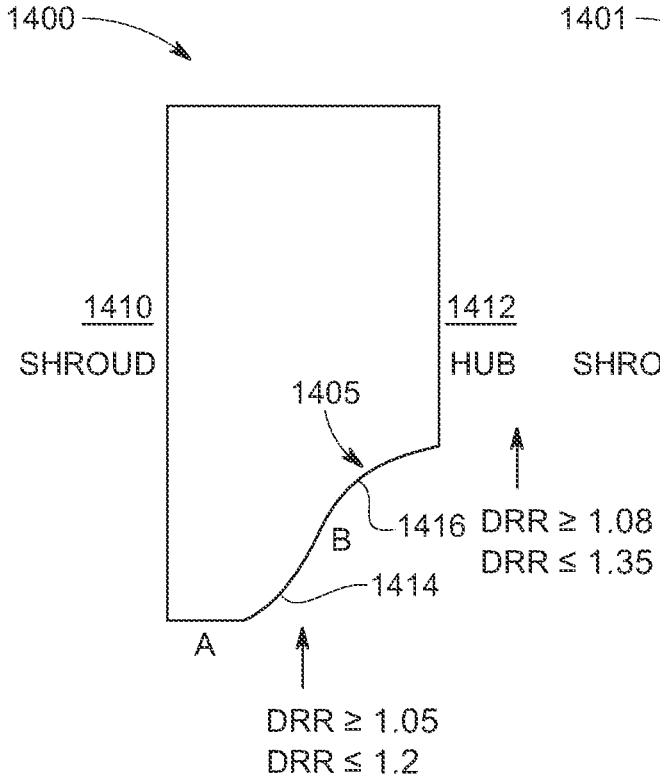
FIG. 14A-FIG. 14D illustrate various alternative embodiments employing varying sculpted leading edges in accordance with various alternative embodiments.
Figure 14B:
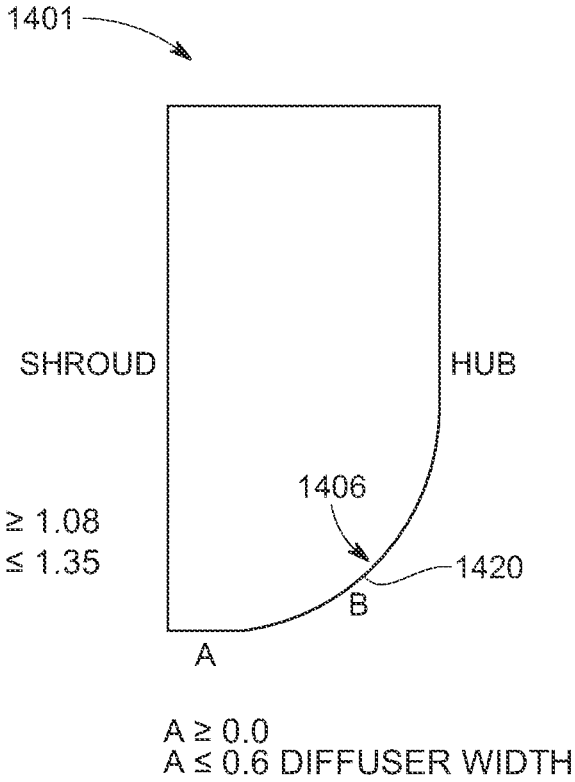
Figure 14C:
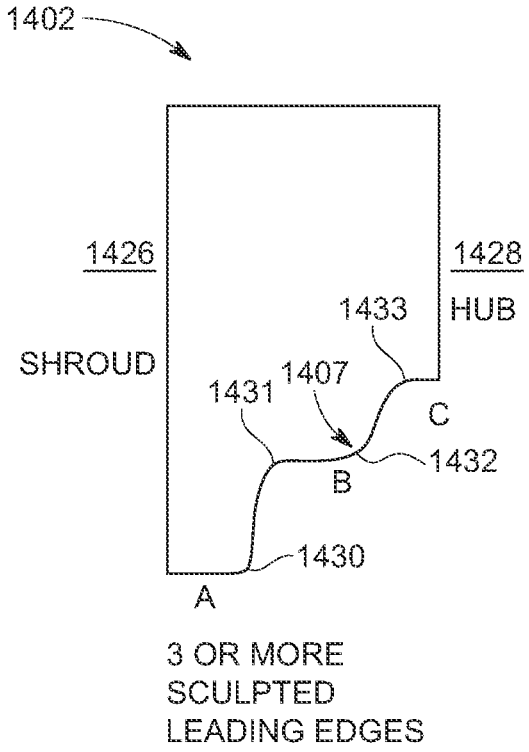
Figure 14D:
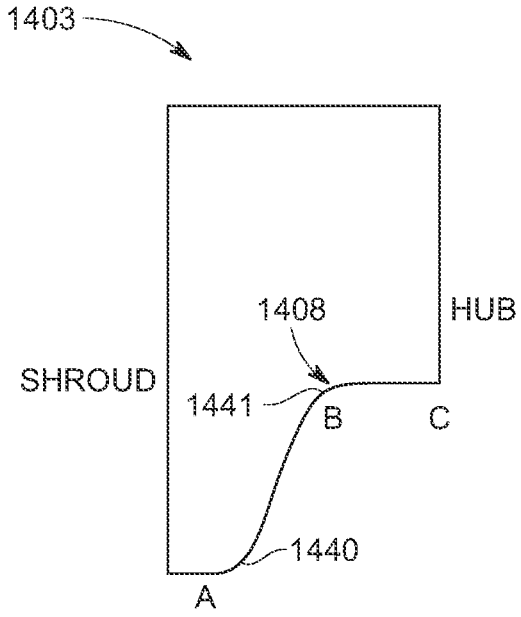

As shown in FIG. 14A to FIG. 14D, the sculpted leading edge may take different shapes in different embodiments. In FIG. 14A, the sculpted leading edge 1405 comprises a flat segment A on the shroud side 1410 and includes a curved segment B on the hub side 1412. Note that there are two inflection points 1414, 1416 in the curved segment B of FIG. 14A. In FIG. 14B, the curved segment B of the leading edge 1406 includes only a single inflection point 1420. The sculpted leading edge 1407 in FIG. 14C includes not only a first flat segment A on the shroud side 1426 but also a second flat segment C on the hub side 1428 with a curved segment B disposed therebetween. The curved segment B includes four inflection points 1430-1433. In FIG. 14D, the sculpted leading edge 1408 again includes first and second flat segments A, C but the curved segment B therebetween contains only two inflection points 1440-1441.

Stated more mathematically, the length of the flat segment A could be zero (i.e., no flat segment) or may be greater than zero as a percentage of the total diffuser width. The point is that the curve in the sculpted leading edge could start exactly at the shroud side or, if the parameter A is greater than zero, it might have a flat line and then that curve might start at 20% across the width of the vane. It is anticipated that the parameter A may be between zero and 60% of the diffuser width, inclusive. The sculpted leading edge is designed to capture the low radial momentum flow on the shroud side of the diffuser instance to preclude a stall cell from forming.

In addition to that, historically these vanes have been flat plates or simple air foils. Some embodiments of the disclosed vane may bend the leading edge in a direction transverse to the leading edge, particularly on the hub side, to better match the angle of attack of the fluid as it approaches.

Figure 15:
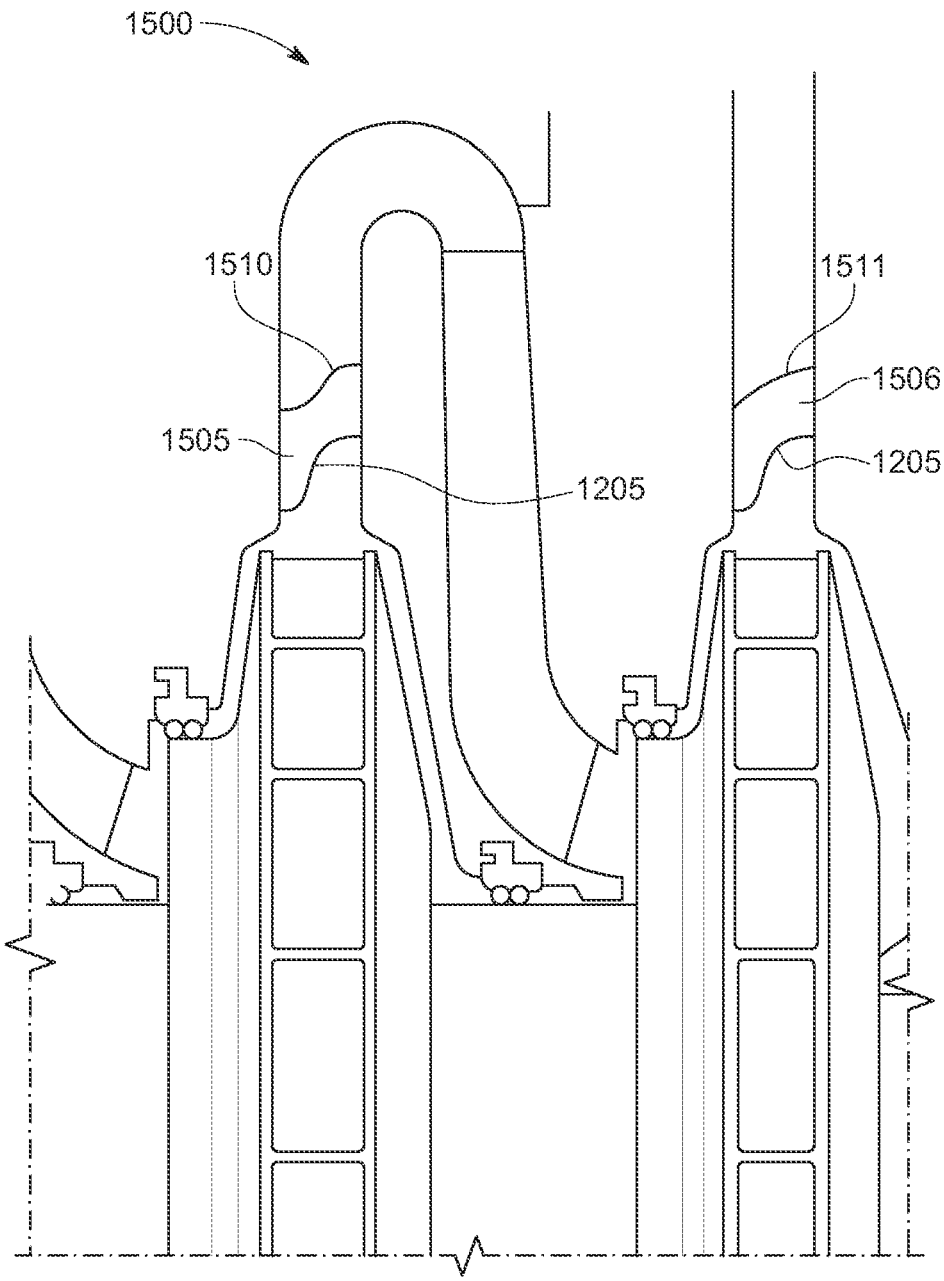
FIG. 15 provides an exemplary view of one sculpted leading edge and a sculpted trailing edge in accordance with one or more embodiments of the subject matter claimed below.

In each of the embodiments discussed above, while the leading edge is sculpted the trailing edge is unsculpted in that the entire width of the diffuser is co-linear with the axis of rotation for the impeller. As mentioned above, in some embodiments, the trailing edge of the vane may be sculpted as well as the leading edge. FIG. 15 illustrates one such particular embodiment deployed in a centrifugal compressor 1500.

Figure 16:
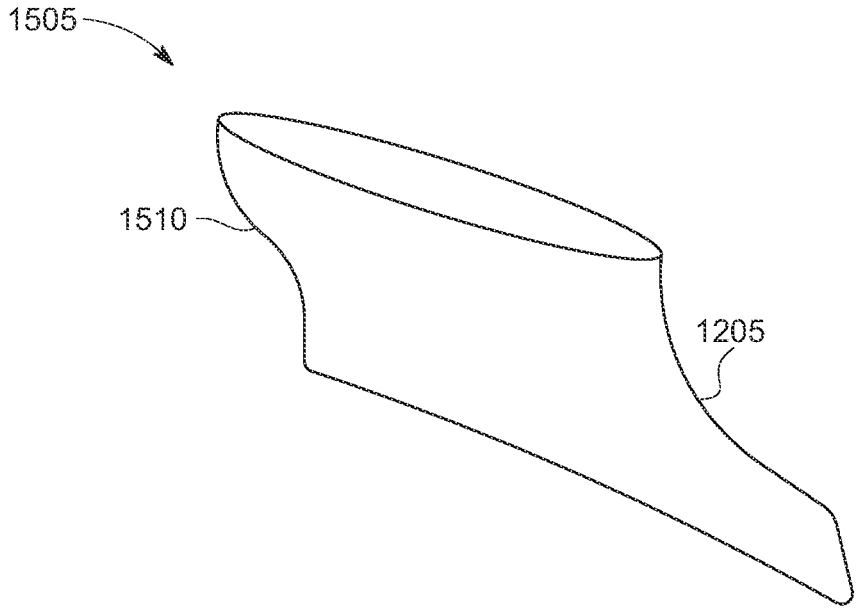
FIG. 16 shows an LSD vane in accordance with one or more embodiments of the subject matter claimed below that includes a sculpted leading edge and a sculpted trailing edge where the vane leading edge and trailing edge are not co-linear to the axis of rotation.

The centrifugal compressor 1500 includes two LSD vanes 1505, 1506. Each of the vanes 1505, 1506 includes a sculpted leading edge 1205. However, the vanes 1505, 1506 have differing, sculpted trailing edges 1510, 1511. Note that, in some embodiments, the trailing edges 1510, 1511 may be of the same design. Similarly, in some embodiments, the vanes 1505, 1506 may have differing leading edges 1205. (The same is true of the embodiment shown in FIG. 12.) The vane 1505 is shown enlarged and removed from the centrifugal compressor 1500 in FIG. 16.

FIG. 17A-FIG. 17D illustrate various alternative embodiments employing varying sculpted leading edges and sculpted trailing edges in accordance with various alternative embodiments. The vane 1700 includes a sculpted leading edge 1405, the vane 1701 includes a sculpted leading edge 1406, the vane 1702 includes a sculpted edge 1407, and the vane 1703 includes a sculpted leading edge 1408. The sculpted leading edges 1405-1408 in FIG. 17A-FIG. 17D are the same as the sculpted leading edges 1405-1408 shown in FIG. 14A-FIG. 14D and discussed above.

Figure 17A:
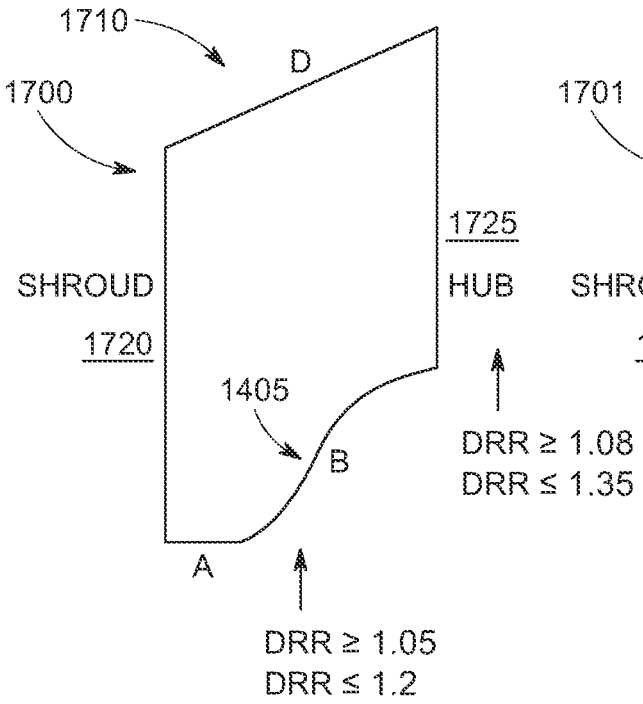
FIG. 17A-FIG. 17D illustrate various alternative embodiments employing varying sculpted leading edges and sculpted trailing edges in accordance with various alternative embodiments.
Figure 17B:
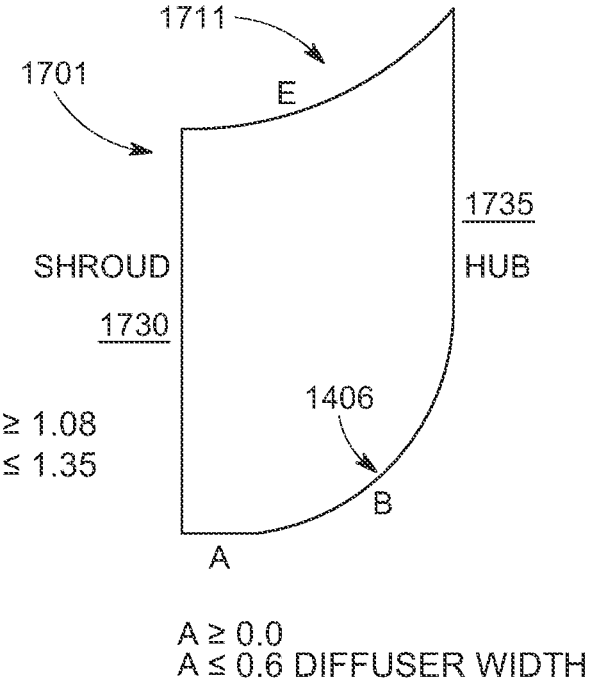
Figure 17C:
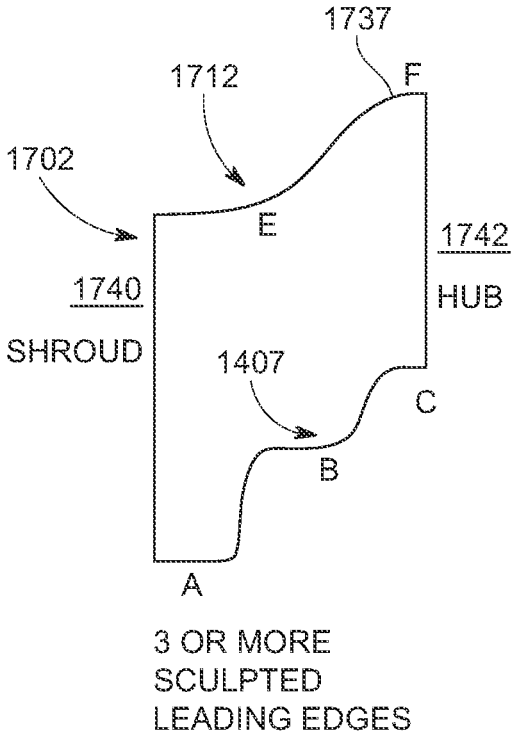
Figure 17D:
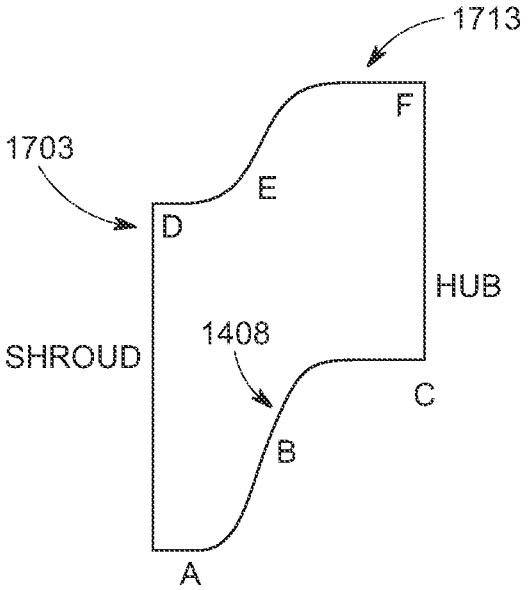

The sculpted trailing edges 1710-1713 differ, however. The sculpted trailing edge 1710 in FIG. 17A comprises a single straight portion D angled relative to the axis of rotation for the impeller from the shroud side 1720 to the hub side 1725 at a single, continuous angle. In FIG. 17B, the sculpted trailing edge 1711 includes a single, continuously curved portion E extending from the shroud side 1730 to the hub side 1735. The sculpted trailing edge 1712 in FIG. 14C includes a continuously curved portion E up to the inflection point 1737 and finishes with the flat portion F as the sculpted trailing edge 1712 extend from the shroud side 1740 to the hub side 1742. The sculpted leading edge 1408 in FIG. 17D presents two flat portions and A and C separated by a curved portion B having two inflection points. The sculpted trailing edge 1713 likewise includes two flat portions D and F separated by a curved portion E including two inflection points.

In general, considerations the design of the sculpted or sculpted and twisted trailing edge are the same as they are for the sculpted or sculpted and twisted leading edge set forth above. Thus, the diffuser radius ratio of the sculpted trailing edge may vary between 1.01 on the shroud side and 1.35 on the hub side, inclusive. The sculpted trailing edge may include one or more flat segments and one or more curved segments having one or more inflection points. Those in the art having the benefit of this disclosure will appreciate still further similarities and/or parallels in the design of the sculpted trailing edge and the sculpted leading edge.

The presently disclosed vane more effectively manages a complex flow field that varies from hub to shroud in a high velocity region and provides better efficiency, pressure recovery in aerodynamic range. Advantages to the design include capturing the low radial momentum gas on the shroud side diffuser entrance to ensure a stall cell does not form. The design also twists the vane to better match the tangential velocity vector, improving gas to vane incidence angles (angle of attack of an airfoil). The design also effectively manages the complex flow field from hub to shroud providing improved aerodynamic range, efficiency, and pressure recovery for a centrifugal compressor.

Also, the presently disclosed vane may be deployed in a shrouded impeller and/or an unshrouded impeller. (An unshrouded impeller is often called a semi-open impeller.) Thus, in various embodiments the low solidity diffuser vane as disclosed above may disposed in shrouded impellers while in other embodiments the low solidity diffuser vane as disclosed above may disposed in unshrouded, or semi-open, impellers. Note that an unshrouded impeller will have a hub side disc but no shroud side disc.

Accordingly, in a first embodiment, a low solidity diffuser vane comprises a vane body including a shroud side, a hub side, and a sculpted leading edge connecting the shroud side to the hub side.

In a second embodiment, in the low solidity diffuser vane of the first embodiment, the sculpted leading edge is defined by varying the diffuser radius ratio along the leading edge.

In a third embodiment, in the low solidity diffuser vane of the second embodiment, the diffuser radius ratio varies between 1.01 on the shroud side and 1.35 on the hub side, inclusive.

In a fourth embodiment, in the low solidity diffuser vane of the second embodiment, the sculpted leading edge includes only a single inflection point.

In a fifth embodiment, in the low solidity diffuser vane of the second embodiment, the sculpted leading edge includes a plurality of inflection points.

In a sixth embodiment, in the low solidity diffuser vane of the fifth embodiment, the sculpted leading edge includes two inflection points.

In a seventh embodiment, in the low solidity diffuser vane of the second embodiment, the sculpted leading edge comprises a flat segment on the shroud side and a curved segment on the hub side.

In an eighth embodiment, in the low solidity diffuser vane of the second embodiment, the sculpted leading edge includes a first flat segment on the shroud side, a second flat segment on the hub side, and a curved segment therebetween.

In a ninth embodiment, in the low solidity diffuser vane of the eighth embodiment, the curved segment includes a plurality of inflection points.

In a tenth embodiment, in the low solidity diffuser vane of the seventh embodiment, the vane width of the flat segment varies between 0% and 60% of the diffuser width inclusive; and the diffuser ratio radius of the curved segment varies between 1.01 and 1.35 inclusive.

In an eleventh embodiment, in the low solidity diffuser vane of the seventh embodiment, the curved segment includes at least one inflection point.

In a twelfth embodiment, in the low solidity diffuser vane of the first embodiment, the sculpted leading edge is twisted to match or approximate tangential velocity vector of a fluid exiting an impeller.

In a thirteenth embodiment, in the low solidity diffuser vane of the first embodiment, the sculpted leading edge is defined by varying the distance of the leading edge from an impeller.

In a fourteenth embodiment, in the low solidity diffuser vane of the first embodiment, the vane body includes a sculpted trailing edge connecting the shroud side to the hub side.

In a fifteenth embodiment, an impeller for use in a centrifugal compressor, comprises a diffuser body defining a plurality of passageways and a plurality of low solidity diffuser vanes, each low solidity diffuser vane disposed within a respective passageway, the low solidity diffuser vanes each including a shroud side, a hub side, and a sculpted leading edge connecting the shroud side to the hub side.

In a sixteenth embodiment, in the impeller of the fifteenth embodiment, the sculpted leading edge is defined by varying the diffuser radius ratio along the leading edge.

In a seventeenth embodiment, in the impeller of the fifteenth embodiment, the sculpted leading edge is twisted to match or approximate a tangential velocity vector of a fluid exiting the impeller.

In an eighteenth embodiment, in the impeller of the fifteenth embodiment, the sculpted leading edge is defined by varying the distance of the leading edge from the impeller.

In a nineteenth embodiment, in the impeller of the fifteenth embodiment, the low solidity diffuser vane further includes a sculpted trailing edge connecting the shroud side to the hub side.

In a twentieth embodiment, a centrifugal compressor comprises an impeller having a diffuser body defining a plurality of passageways, and a plurality of low solidity diffuser vane. Each low solidity vaned diffuser is disposed within a respective passageway and comprises a vane body including a shroud side, a hub side, and a sculpted leading edge connecting the shroud side to the hub side, the sculpted leading edge defined by varying the distance of the leading edge from an impeller or by varying the diffuser radius ratio along the leading edge.

In a twenty-first embodiment, in the centrifugal compressor of the twentieth embodiment, the sculpted leading edge includes only a single inflection point.

In a twenty-second embodiment, in the centrifugal compressor of the twentieth embodiment, the sculpted leading edge includes a plurality of inflection points.

In a twenty-third embodiment, in the centrifugal compressor of the twentieth embodiment, the sculpted leading edge comprises a flat segment on the shroud side and a curved segment on the hub side.

In a twenty-fourth embodiment, in the centrifugal compressor of the twentieth embodiment, the sculpted leading edge includes a first flat segment on the shroud side, a second flat segment on the hub side, and a curved segment therebetween.

In a twenty-fifth embodiment, in the centrifugal compressor of the twentieth embodiment, the sculpted leading edge is twisted to match or approximate tangential velocity vector of a fluid exiting an impeller.

In a twenty-sixth embodiment, in the centrifugal compressor of the twentieth embodiment, the vane body further includes a sculpted trailing edge.

In a twenty-seventh embodiment, in the centrifugal compressor of the twentieth embodiment, the impeller is a shrouded impeller.

In a twenty-eighth embodiment, in the centrifugal compressor of the twentieth embodiment, the impeller is an unshrouded impeller.

Expressions such as “include” and “may include” which may be used in the present disclosure denote the presence of the disclosed functions, operations, and constituent elements, and do not limit the presence of one or more additional functions, operations, and constituent elements. In the present disclosure, terms such as "include" and/or "have", may be construed to denote a certain characteristic, number, operation, constituent element, component or a combination thereof, but should not be construed to exclude the existence of or a possibility of the addition of one or more other characteristics, numbers, operations, constituent elements, components or combinations thereof.

As used herein, the article "a" is intended to have its ordinary meaning in the patent arts, namely "one or more." Herein, the term "about" when applied to a value generally means within the tolerance range of the equipment used to produce the value, or in some examples, means plus or minus 10%, or plus or minus 5%, or plus or minus 1%, unless otherwise expressly specified. Further, herein the term "substantially" as used herein means a majority, or almost all, or all, or an amount with a range of about 51% to about 100%, for example. Moreover, examples herein are intended to be illustrative only and are presented for discussion purposes and not by way of limitation.

As used herein, to "provide" an item means to have possession of and/or control over the item. This may include, for example, forming (or assembling) some or all of the item from its constituent materials and/or, obtaining possession of and/or control over an already-formed item.

Unless otherwise defined, all terms including technical and/or scientific terms used herein have the same meaning as commonly understood by one of ordinary skill in the art to which the present disclosure pertains. In addition, unless otherwise defined, all terms defined in generally used dictionaries may not be overly interpreted. In the following, details are set forth to provide a more thorough explanation of the embodiments. However, it will be apparent to those skilled in the art that embodiments may be practiced without these specific details. In other instances, well-known structures and devices are shown in block diagram form or in a schematic view rather than in detail in order to avoid obscuring the embodiments. In addition, features of the different embodiments described hereinafter may be combined with each other, unless specifically noted otherwise. For example, variations or modifications described with respect to one of the embodiments may also be applicable to other embodiments unless noted to the contrary.

Further, equivalent or like elements or elements with equivalent or like functionality are denoted in the following description with equivalent or like reference numerals. As the same or functionally equivalent elements are given the same reference numbers in the figures, a repeated description for elements provided with the same reference numbers may be omitted. Hence, descriptions provided for elements having the same or like reference numbers are mutually exchangeable.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

In the present disclosure, expressions including ordinal numbers, such as "first", "second", and/or the like, may modify various elements. However, such elements are not limited by the above expressions. For example, the above expressions do not limit the sequence and/or importance of the elements. The above expressions are used merely for the purpose of distinguishing an element from the other elements. For example, a first box and a second box indicate different boxes, although both are boxes. For further example, a first element could be termed a second element, and similarly, a second element could also be termed a first element without departing from the scope of the present disclosure.

Use of the phrases "capable of," "capable to," "operable to," or "configured to" in one or more embodiments, refers to some apparatus, logic, hardware, and/or element designed in such a way to enable the use of the apparatus, logic, hardware, and/or element in a specified manner. Use of the phrase "exceed" in one or more embodiments, indicates that a measured value could be higher than a pre-determined threshold (e.g., an upper threshold), or lower than a pre-determined threshold (e.g., a lower threshold). When a pre-determined threshold range (defined by an upper threshold and a lower threshold) is used, the use of the phrase "exceed" in one or more embodiments could also indicate a measured value is outside the pre-determined threshold range (e.g., higher than the upper threshold or lower than the lower threshold). The subject matter of the present disclosure is provided as examples of apparatus, systems, methods, circuits, and programs for performing the features described in the present disclosure. However, further features or variations are contemplated in addition to the features described above. It is contemplated that the implementation of the components and functions of the present disclosure can be done with any newly arising technology that may replace any of the above-implemented technologies.

This concludes the detailed description. The particular embodiments disclosed above are illustrative only, as the claimed subject matter may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the claims. Accordingly, the protection sought herein is as set forth in the claims below.

What is claimed is:

1. A low solidity diffuser vane, comprising:

a vane body including a shroud side, a hub side, and a sculpted leading edge connecting the shroud side to the hub side, the sculpted leading edge being defined by varying from the shroud side to the hub side a diffuser radius ratio along the leading edge between 1.01 on the shroud side and 1.35 on the hub side, inclusive.

2. The low solidity diffuser vane of claim 1, wherein the sculpted leading edge includes only a single inflection point.

3. The low solidity diffuser vane of claim 1, wherein the sculpted leading edge includes a plurality of inflection points.

4. The low solidity diffuser vane of claim 3, wherein the sculpted leading edge includes two inflection points.

5. The low solidity diffuser vane of claim 1, wherein the sculpted leading edge comprises a flat segment on the shroud side and a curved segment on the hub side.

6. The low solidity diffuser vane of claim 1, wherein the sculpted leading edge includes a first flat segment on the shroud side, a second flat segment on the hub side, and a curved segment therebetween.

7. The low solidity diffuser vane of claim 6, wherein the curved segment includes a plurality of inflection points.

8. The low solidity diffuser vane of claim 5, wherein:

a vane width of the flat segment is less than or equal to 60% of a diffuser width; and the diffuser ratio radius of the curved segment varies between 1.01 and 1.35 inclusive.

9. The low solidity diffuser vane of claim 5, wherein the curved segment includes at least one inflection point.

10. The low solidity diffuser vane of claim 1, wherein the sculpted leading edge is twisted to match or approximate tangential velocity vector of a fluid exiting an impeller.

11. The low solidity diffuser vane of claim 1, wherein the vane body includes a sculpted trailing edge connecting the shroud side to the hub side.

12. An impeller for use in a centrifugal compressor, comprising:

a diffuser body defining a plurality of passageways; and a plurality of low solidity diffuser vanes, each low solidity diffuser vane disposed within a respective passageway, the low solidity diffuser vanes each including a shroud side, a hub side, and a sculpted leading edge connecting the shroud side to the hub side, the sculpted leading edge being defined by varying the diffuser radius ratio along the leading edge between 1.01 on the shroud side and 1.35 on the hub side.

13. The impeller of claim 12, wherein the sculpted leading edge is defined by varying a diffuser radius ratio along the leading edge.

14. The impeller of claim 12, wherein the sculpted leading edge is twisted to match or approximate a tangential velocity vector of a fluid exiting the impeller.

15. The impeller of claim 12, wherein the low solidity diffuser vane further includes a sculpted trailing edge connecting the shroud side to the hub side.

16. A centrifugal compressor, comprising:

an impeller having a diffuser body defining a plurality of passageways; and a plurality of low solidity diffuser vanes, each low solidity diffuser vane disposed within a respective passageway and comprising a vane body including a shroud side, a hub side, and a sculpted leading edge connecting the shroud side to the hub side, the sculpted leading edge defined by varying the distance of a leading edge from an impeller or by varying a diffuser radius ratio along the leading edge between 1.01 on the shroud side and 1.35 on the hub side.

17. The centrifugal compressor of claim 16, wherein the sculpted leading edge includes only a single inflection point.

18. The centrifugal compressor of claim 16, wherein the sculpted leading edge includes a plurality of inflection points.

19. The centrifugal compressor of claim 16, wherein the sculpted leading edge comprises a flat segment on the shroud side and a curved segment on the hub side.

20. The centrifugal compressor of claim 16, wherein the sculpted leading edge includes a first flat segment on the shroud side, a second flat segment on the hub side, and a curved segment therebetween.

21. The centrifugal compressor of claim 16, wherein the sculpted leading edge is twisted to match or approximate tangential velocity vector of a fluid exiting an impeller.

22. The centrifugal compressor of claim 16, wherein the vane body further includes a sculpted trailing edge.

23. The centrifugal compressor of claim 16, wherein the impeller is a shrouded impeller.

24. The centrifugal compressor of claim 16, wherein the impeller is an unshrouded impeller.

* * * * *